United States Patent [19]

Nishiyama et al.

[11] Patent Number: 4,746,957

[45] Date of Patent: May 24, 1988

[54] VARIABLE MAGNIFICATION COPY MACHINE

[75] Inventors: Haruo Nishiyama, Kyoto; Masaru Tsuji, Nara, both of Japan

[73] Assignee: Sharp Kabushiki Kaisha, Osaka, Japan

[21] Appl. No.: 886,342

[22] Filed: Jul. 17, 1986

[30] Foreign Application Priority Data

Jul. 17, 1985 [JP] Japan ..... 60-159430
Jul. 17, 1985 [JP] Japan ..... 60-159431
Jul. 17, 1985 [JP] Japan ..... 60-159432

[51] Int. Cl.[4] ..... G03G 15/00
[52] U.S. Cl. ..... 355/55; 355/15
[58] Field of Search ..... 355/55, 60, 61, 62, 355/8, 15, 16

[56] References Cited

U.S. PATENT DOCUMENTS 4,105,326 8/1978 Mochimaru ..... 355/55
4,299,475 11/1981 Nagahara ..... 355/8
4,340,297 7/1982 Tamura et al. ..... 355/8 X
4,368,976 1/1983 Shogren ..... 355/55
4,384,784 5/1983 Mayer ..... 355/55 X
4,436,416 3/1984 Negoro et al. ..... 355/8 X
4,494,866 1/1985 Rattin et al. ..... 355/8 X
4,568,171 2/1986 Ikenoue ..... 355/8
4,589,760 5/1986 Iimori ..... 355/8
4,607,943 8/1986 Yoshioka ..... 355/8 X
4,655,581 4/1987 Yamada ..... 355/15 X

*Primary Examiner*—R. L. Moses
*Attorney, Agent, or Firm*—Birch, Stewart, Kolasch & Birch

[57] ABSTRACT

In a variable magnification copy machine in which a scanning velocity of a scanning device can be varied according to a designated magnification, and either a two revolution process or a three revolution process is utilized, there is provided a device for selecting the two revolution process when the equal magnification mode is selected and for switching from the two revolution process to the three revolution process when the enlargement mode is chosen. Even further, there are respective driving clutches corresponding to each of reduction, equal magnification and enlargement modes in which the copying speed is not slowed down in the enlargement mode by switching clutches upon returning the platen to a home position.

6 Claims, 9 Drawing Sheets

VARIABLE MAGNIFICATION COPY MACHINE

BACKGROUND OF THE INVENTION

1. Field of the Invention

The present invention relates to a variable magnification copy machine in which a scanning velocity of a scanning means can be varied corresponding to a 2. Description of the Prior Art In a variable magnification copy machine, the copying magnification can be varied by changing the scanning velocity for a document to be copied. Due to this, the reciprocal travel time of a document scanner means in the enlargement mode takes longer than that in the equal magnification mode in general. Especially, in a conventional copy machine wherein the document platen is moved to scan a document by a driving device including a few one-way clutches, it is impossible to make the document platen return in the direction of the scan since the document platen is driven by a so-called chain-delivery mechanism. In other words, it is impossible to make the platen return from a position corresponding to a top end of a document.

Further, in such a conventional variable magnification copy machine as mentioned above, there are provided a plurality of one-way clutches the number of which is equal to the number of selectable magnifications and, therefore, the running velocity of the chain is varied by switching these clutches. However, since it is hardly possible to change the running velocity of the chain mid way, the scanning velocity of a document upon an exposure and the returning velocity of the document platen become equal as far as one chain-delivery mechanism is installed therein.

Accordingly, when the enlargement mode is selected, both of moving times for going and returning become longer than those in the equal magnification mode and, therefore, the total moving time becomes considerably long.

On the contrary to the above, processes to be employed in a copy machine are so designed, in order to obtain a high speed copy machine, that a stop time of the platen at the starting position thereof can be shortened as short as possible during a multi-copy mode when it is transferred from one copying cycle to the next copying cycle. However, it becomes very difficult to optimize processes corresponding to an individual mode in the case that the moving time of the platen is varied according to the mode selected as mentioned above. In order to avoid these difficulties, processes are so optimized as to meet with the enlargement mode in a conventional variable magnification copy machine wherein a plurality of one-way clutches are used and, accordingly, the waiting time of the platen for adjusting timings is needed and it is determined relatively long when the equal magnification mode or the reduction mode is selected in which the moving time of the platen is relatively short. Namely, the copying cycle can not be speeded up since the waiting time (stop time) of the platen is needed for adjusting timings in the equal magnification mode or the reduction mode.

SUMMARY OF THE INVENTION

One object of the present invention is to provide a variable magnification copy machine in which any waiting time for timing adjustment is not needed in the equal magnification mode or the reduction mode by utilizing a two revolution process and a three revolution process.

To this end, there is provided, according to the present invention, a variable magnification copy machine in which either a two revolution process wherein the erasing and cleaning of a photo-sensitive device is carried out once in one copying cycle or a three revolution process said said erasing and cleaning of the photo-sensitive device is carried out twice in one copying cycle can be selected and in which a copying magnification is variable by varying a document scanning speed. The present invention is characterized in that there is provided means for selecting the two revolution process when the equal magnification mode is chosen and for switching from the two revolution process to the three revolution process when the enlargement mode is chosen.

According to the present invention, since there is one more revolution in the enlargement mode when compared with at least the equal magnification mode, the time increased for one more revolution can be shared to a moving time of the platen in the enlargement mode which becomes longer than that in the equal magnification mode. Namely, the timing for movement of the platen in the equal magnification mode can be set independent from that in the enlargement mode and, therefore, the waiting time for adjustment of timings between the equal magnification mode and the enlargement mode is unnecessary.

Another object of the present invention is to provide a variable magnification copy machine comprising respective driving clutch means corresponding to each of reduction, equal magnification and enlargement modes in which the copying speed is not so slowed down in the enlargement mode by switching clutch means upon returning of the platen.

To this end, there is provided a variable magnification copy machine in which a scanning speed of a document scanning means is so controlled as to vary according to a copying magnification designated by selecting a one-way clutch means according to the magnification, being characterized in that there is provided a switch means for switching from one-way clutch means for the enlargement mode to the one-way clutch means for the reduction mode at the time that the document scanning means is started to return in the enlargement mode.

According to the present invention, when the enlargement mode is selected, the scanning means is moved to scan a document at a speed corresponding to the enlargement mode, but it is returned at a speed corresponding to the reduction mode. Therefore, the copying cycle time in the enlargement mode can be reduced as a whole.

DESCRIPTION OF THE PREFERRED EMBODIMENTS

First Embodiment

Figure 1:
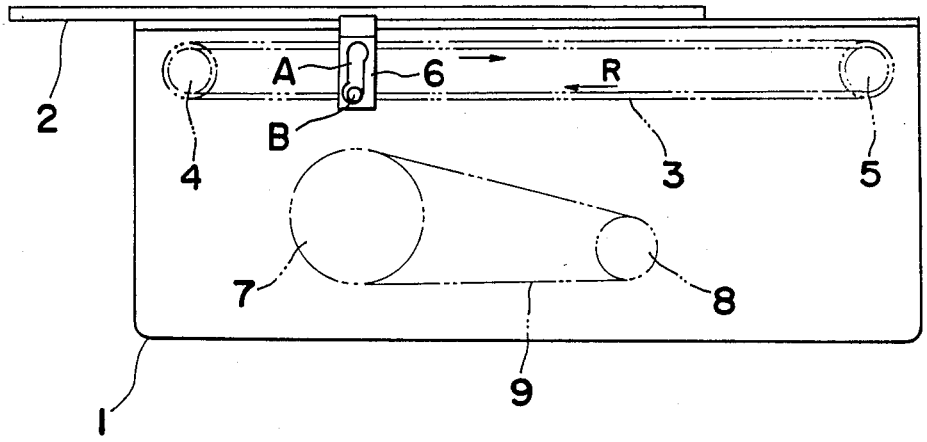
FIG. 1 is a side view of a copy machine showing a driving mechanism for driving a document platen.
Figure 2:
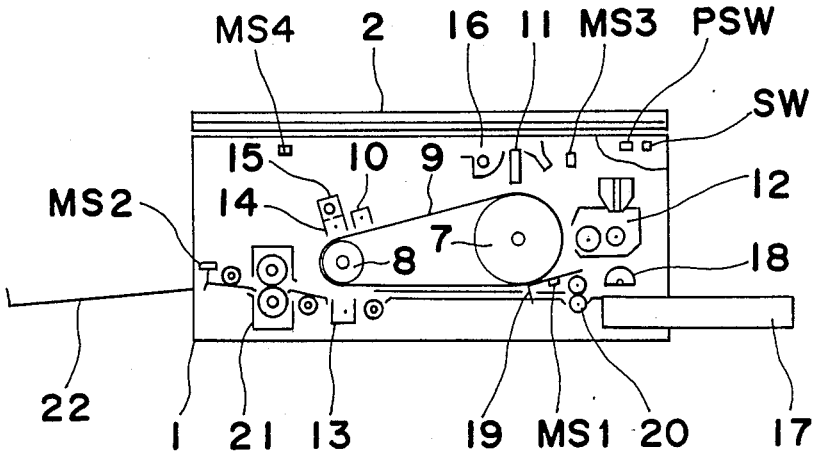
FIG. 2 is a sectional view of the copy machine of FIG. 1.
Figure 3:
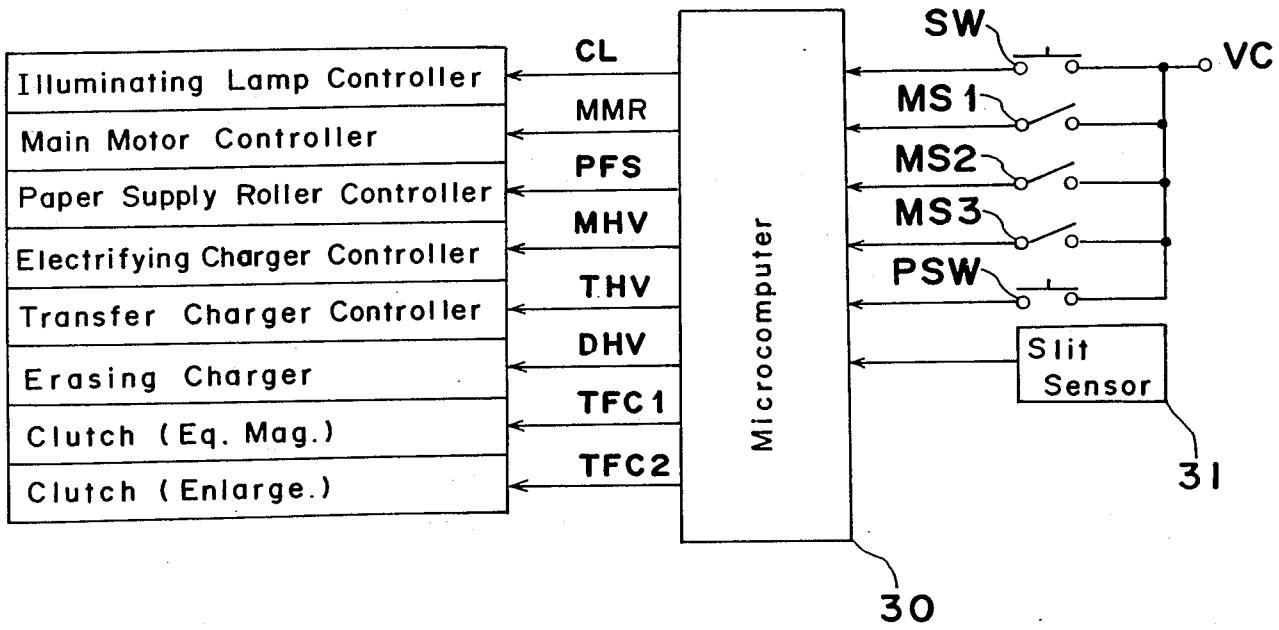
FIG. 3 is a block diagram of a control circuit of the copy machine.

FIGS. 1, 2 and 3 show a variable magnification copy machine according to a preferred embodiment of the present invention in which FIG. 1 is a side view of the copy machine showing a driving mechanism for driving a document platen, FIG. 2 is a sectional view of copy machine and FIG. 3 is a block diagram of a control circuit of the copy machine.

In the variable magnification copy machine, the process may be selected which is accompanied with two revolutions, wherein an electrical erasing and cleaning of a photo-sensitive body are carried out one time per one copying cycle additionally the process may be selected which is accompanied with three revolutions, wherein the erasing and cleaning are carried out two times per one copying. Further, the equal magnification and enlargement modes are selectable. When the equal magnification mode is designated, the process accompanied with two revolutions is chosen. And, when the enlargement mode is designated, the process accompanied with three revolutions is chosen. The modes are selectably designated by operating a key or button arranged on an operation board.

As shown in FIG. 1, a document platen 2 is arranged slidably in the lengthwise direction thereof on the top deck of the main body 1 of a copy machine. The document platen 2 is driven reciprocally by a chain delivery mechanism. The chain delivery mechanism includes an endless chain 3 being spanned between two gears 4 and 5 and parallel to the document platen 2. One gear 5 of these gears is a driving gear for driving the chain and the other one 4 is a driven gear. The driving gear 5 can be driven to rotate at each of two different rotational velocities through a velocity transforming mechanism (not shown). The velocity transforming mechanism includes two one-way clutches, each of which transmits a driving force to the driving gear 5 to give a rotational velocity corresponding thereto when it is selected to operate. Namely, the running velocity of the chain 3 is varied by switching these two clutches.

The document platen 2 and endless chain 3 are connected to each other with an angle plate member 6. A ball means B is fixed to the chain 3 at a predetermined position thereof and is movably engaged in a notched portion A which is formed on the vertical wall portion of the angle plate member 6. When the endless chain 3 is driven in a clockwise direction (as indicated by an arrow R in FIG. 1) and the ball B is positioned at a lower portion of the notched portion A, the document platen 2 is moved toward the left side of FIG. 1 since the angle plate member 6 is moved toward the left side together with the ball B. When the angle plate member 6 reaches at the position of the driven gear 4, the ball is moved upward in the notched portion A engage to the top portion thereof. The angle plate member 6, then, is moved to the right being accompanied by the running of the endless chain 3. Namely, the document platen 2 is moved to the right. Thus, the document platen 2 can be reciprocated at an individual velocity only by switching clutches.

As indicated by phantom lines in FIG. 1, a photo-sensitive belt 9 is spanned between two rollers 7 and 8.

FIG. 2 shows essential elements of the copy machine.

Along the photo-sensitive belt 9, there are arranged an electrifying charger 10, a converging light transmitter means 11, a developer 12, a transferring charger 13, an erasing charger 14, and an erasing lamp 15. The electrifying charger 10 electrifies the photo-sensitive belt 9 homogeneously. The converging light transmitter means 11 projects light rays reflected from a document to expose said photo-sensitive belt 9 therewith. The developer 12 develops a latent image formed on the belt with toner. The transferring charger 13 transfers the toner image on the belt to a copy paper. The erasing charger 14 and erasing lamp 15 erase charges on the belt.

A light source 16 is arranged near the converging light transmitter means 11 to illuminate a document on the platen 2.

At the right bottom portion of the main body 1, a cassette 17 for supplying a copy paper is set. A paper supply roller 18 serves to feed one copy paper from the cassette 17 into the main body 1. The copy paper fed by the paper supply roller 18 is stopped once at a position of a temporary stopper 19. A pair of paper sending rollers 20 send the one copy paper stopped by the stopper 19 towards the transferring charger 13 at a predetermined timing. The paper supply roller 18 is rotated by one revolution when a solenoid means (PFS see FIG. 3) is energized.

The copy paper is fixed by fixing means 21 after the toner image has been transferred and, then, is discharged to a tray 22.

On the operation board, there are provided a copy button PSW and a key SW for switching from the equal magnification mode to the enlargement mode or vice versa. When the copy button PSW is pushed, a copying operation is started. When said mode switching key SW is pushed, the mode is switched in turn.

A sensor switch MS1 for sensing an incoming copy paper is arranged between the paper sending roller 20 and a temporary stoppe 19 and a sensor switch MS2 for sensing an outcoming copy paper is arranged behind the developer 21 and, further, a sensor switch MS3 for sensing the stop position of the platen is arranged on the right side of the converging light transmitter means 11.

One more sensor switch MS4 is provided for detecting that the platen has been moved to a predetermined exposure start position.

As shown in FIG. 3, the switching key SW, sensor switches MS1 to MS3, copy button PSW and a slit sensor 31 (and also sensor switch MS4 not shown explicitly in FIG. 3) are connected to respective input terminals of the microcomputer. The slit sensor 31 is supported by the rotational axis of the roller 7 and is includes a photo sensor device for sensing a rotational plate having a slit and a position of the slit thereof. Every output signal of the slit sensor 31 is used as a timing signal for controlling timings of the copying process.

The microcomputer 30 outputs control signals CL for controlling an illuminating lamp controller, main motor controlling signals MMR, control signals PFS for controlling said paper supply roller, control signals MHV for controlling the electrifying charger 10, control signals THV for controlling the transferring charger 13, control signals DHV for controlling the erasing charger 14 and lamp 15, control signals TFC1 for controlling the clutches for driving the platen in the equal magnification mode and control signals TFC2 for controlling another clutch for driving the platen in the enlargement mode, respectively.

Figure 4A:
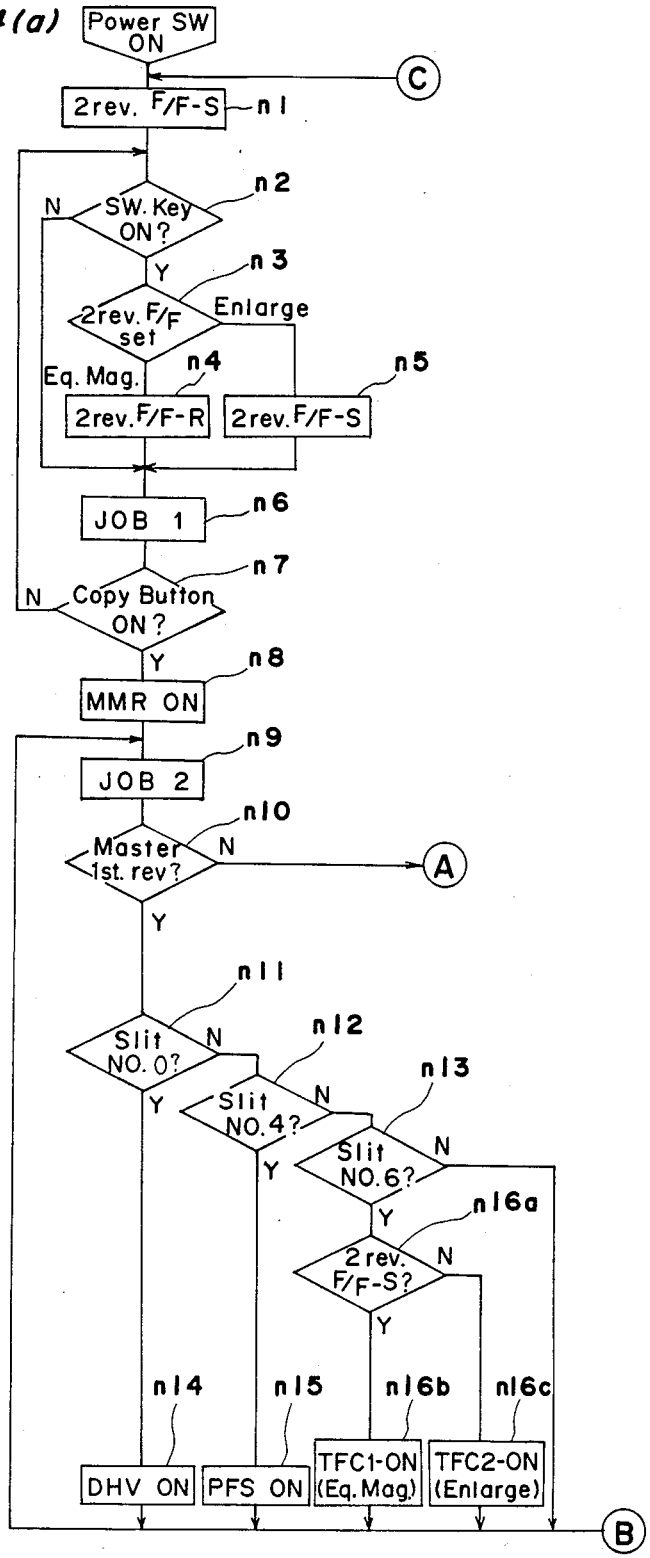
FIGS. 4(*a*) and (*b*) show a flow chart of a control program for a microcomputer.
Figure 4B:
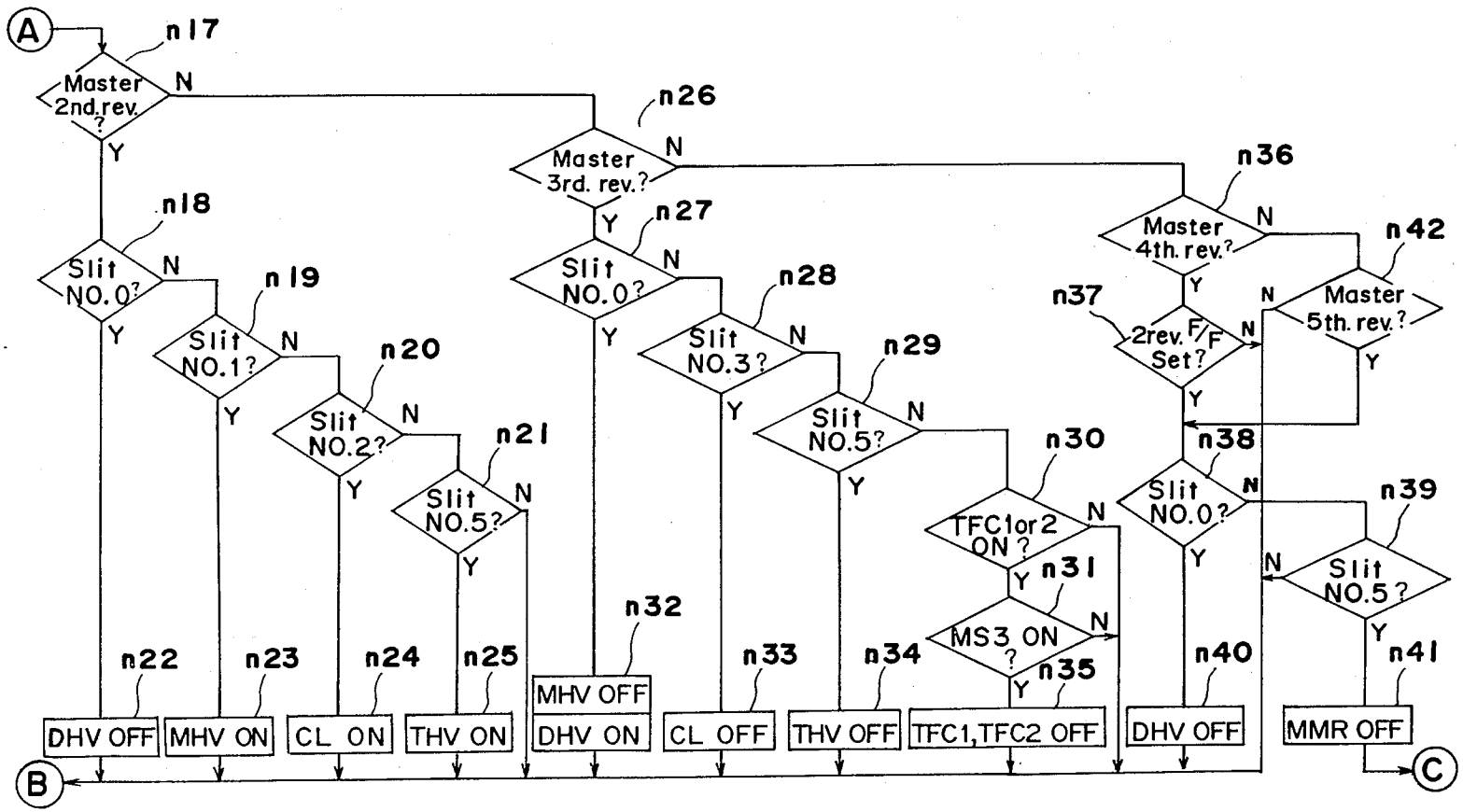

FIGS. 4(*a*) and (*b*) show a flow chart of a control program to be carried out by the microcomputer.

When the power switch is turned on, a flip flop for setting the two revolution process is set at step n1. At this stage, the copy machine is automatically set to the mode in which the two revolution process proceeds. The two revolution process is carried out in the equal magnification mode as will be mentioned hereinafter.

At step n2, it is decided whether the switching key SW was operated or not. If not, the process skips to step n6.

If the switching key was operated, it is checked at step n2 whether the two revolutions flip flop was already set or not. If it was set, the process proceeds to step n4 in order to reset it. If it was decided at step n3 that the two revolution flip flop was reset, the process proceeds to step n5 to set it.

Accordingly, when the process proceeds from step n3 to step n4, the mode is switched to the mode wherein the three revolution process is to be carried out. And, if the process proceeds from step n3 to step n5, the mode is kept unchanged to carry out the two revolution process. As mentioned above, the mode wherein the two revolution process is carried out is the equal magnification mode and the mode for the three revolution process is the enlargement mode.

Next, at step n6, JOB1 for entering a copy number etc. is carried out at step n6 and, when the copy button PSW is pushed at step n7, the process proceeds to step n8 to execute a series of copying operations.

At step n8, the main motor is started to drive by the main motor control signal MMR. Next, JOB2 for executing jobs necessary for carring out one copying operation, for example, turning off a "ready" display is enabled. When the main motor is started to drive, the photo-sensitive belt 9 (hereinafter referred to as the master 9) is started to rotate. If the master 9 is rotated in its first revolution, the process is proceeds to step n10 and, then to step n11 and, from steps n11 to n13, a slit number is decided successively according to the output signal of the slit sensor 31. If the slit number is "0", the signal DHV is made "high" and the erasing charger 14 and lamp 15 are energized at step n14. Namely, since the slit number is "0" at first, the master 9 is erased first. When the slit number is equal to "4", the signal PFS is made "high" and the paper supplying roller 18 is rotated by one revolution at step n15. Therefore, one blank copy paper is supplied from the paper supply cassette 17.

When the slit number is equal to "6", it is decided at step n16*a* whether the two revolution flip flop was set or not. If it was set, the process proceeds to step n16*b* and the clutch for driving the platen in the equal magnification mode is turned on by the signal TFC1. Alternatively, if the two revolution flip flop was reset, the process proceeds to step n16*c* to turn on the clutch (TFC2) for the enlargement mode. These steps from n10 to n16*c* are carried out prior to actual copying operations.

During the second revolution of master 9, steps from n17 to n25 are carried out. Namely, actual copying operations are carried out.

When the slit number is detected to be "0" at step n18, the erasing charger 14 and the lamp 15 are turned off at step n22.

Next, when the slit number becomes "1", the electrifying charger 10 is turned on at step n23. If the slit number is detected to be "2" at step n20, the light source 16 is turned on at step n24. When the slit number is detected to be "5" at step n21, the transferring charger 13 is turned on.

The moving velocity of the platen or scanning velocity in relation to a document during these copying process (n17 to n25) is determined according to which of these two clutches TFC1 and TFC2 was chosen. If the clutch TFC1 is turned on, the moving velocity of the platen is equal to the rotational velocity of the master 9. And, if the clutch TFC2 is turned on, the moving velocity of the platen is slower than that of the master.

When the master 9 is started to rotate in its third revolution, steps n26 to n35 are carried out. During the third revolution, the transferring and cleaning processes are carried out.

When the slit number is detected to be "0" at step n27, the electrifying charger 10 is turned off and, alternatively, the erasing charger 14 and the lamp 15 are turned on at step n32. Therefore, the cleaning process is started. When the slit number is detected to be "3" at step n28, the light source 16 is turned off at step n33. When the slit number is detected to be "5" at step n29, the transferring charger 13 is turned off at step n34.

After turning off the transferring charger 13, the process proceeds to steps n30 and n31 to wait until the platen comes back to the stop position thereof. When the stop position sensor switch MS3 detects that the platen has come back to the stop position, the clutch is turned off at step n35.

When the master 9 is started to rotate in its fourth revolution, the process proceeds to steps n36 and n37. At step n37, it is checked whether the two revolution flip flop is set or not. If it was set, the process proceeds to step n38 to detect the slit number "0". Since it is detected as soon as the master 9 is entered in its fourth revolution, the process proceeds from step n38 to step n40. At step n40, the erasing charger 14 and erasing lamp 15 are turned off. Therefore, all chargers and lamps are turned off. When the process is again proceeded to step n36 after the execution of step n40, the process is to steps n38 and n39 at this time and, then, proceeded to step n41 when the slit number is detected to be "5". At step n41, the main motor is turned off and, then, the process is returned to step n1.

As is apparent from the above description, if the two revolution flip flop was set, the cleaning of the master 9 is done by one time through steps n26 to n40.

On the contrary to the above, if the two revolution flip flop was reset, the process proceeds from step n36 to n37 and, then, returns to step n9 in the fourth revolution of the master 9. Accordingly, step n40 is carried out after the master entered its fifth revolution. Namely, the cleaning is done twice during the third and fourth revolutions.

Conclusively, the two revolution process is to be carried out when the equal magnification mode is selected and the three revolution process is carried out when the enlargement mode was selected.

In the case where a multi copying process is carried out in the equal magnification mode (two revolution process), the next copying cycle is started as soon as the master 9 enters to its fourth revolution. In the case of a multi copy with the three revolution process (the enlargement mode), the next copying cycle is started from the fifth revolution of the master.

Figure 5:
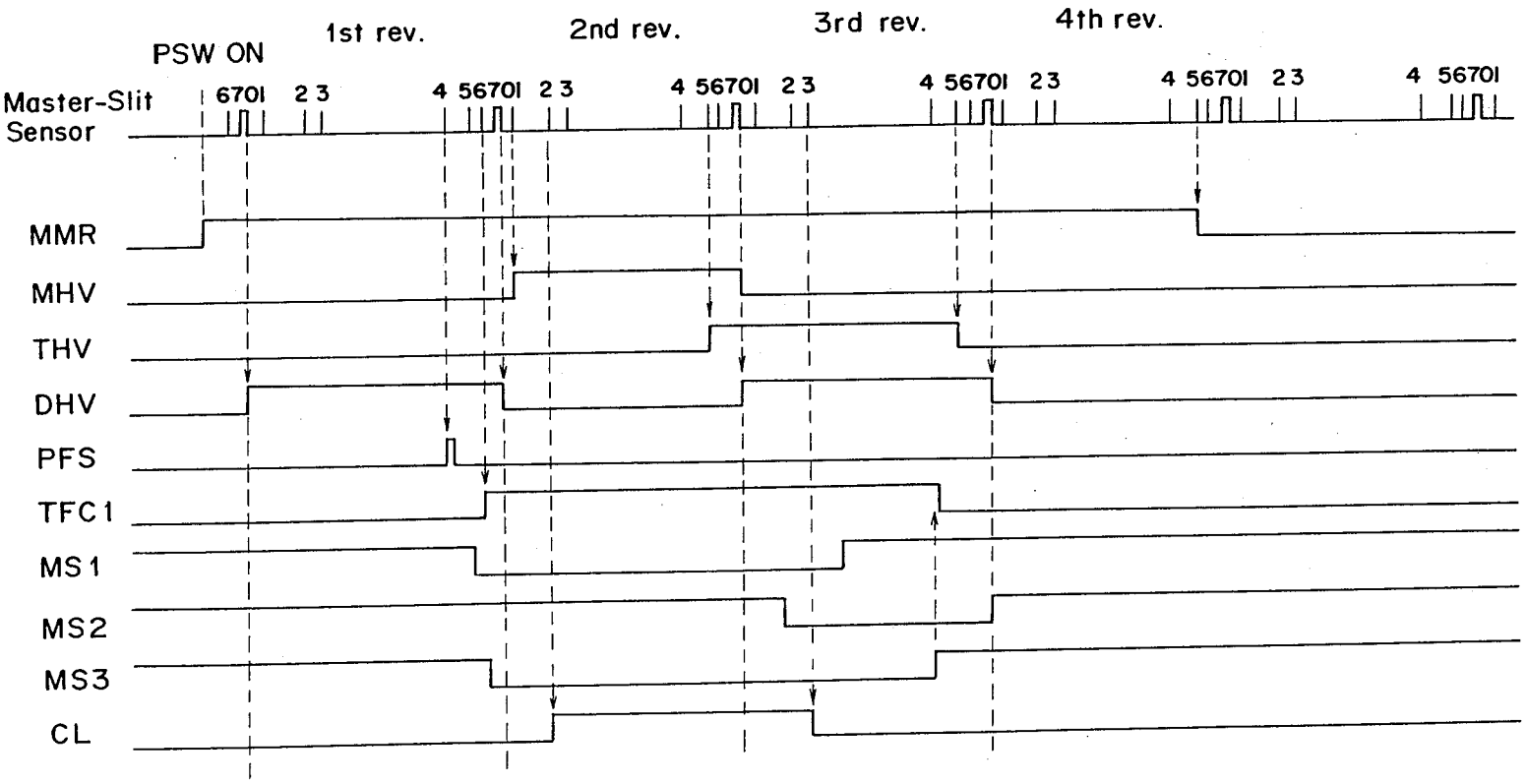
FIG. 5 shows a timing chart at the time that the two revolution process, namely, the equal magnification mode is carried out.

FIG. 5 shows a timing chart for the two revolution process, namely, the equal magnification mode is carried out. Also, FIG. 6 shows a timing chart for the three revolution process, namely, the enlargement mode is carried out.

Figure 6:
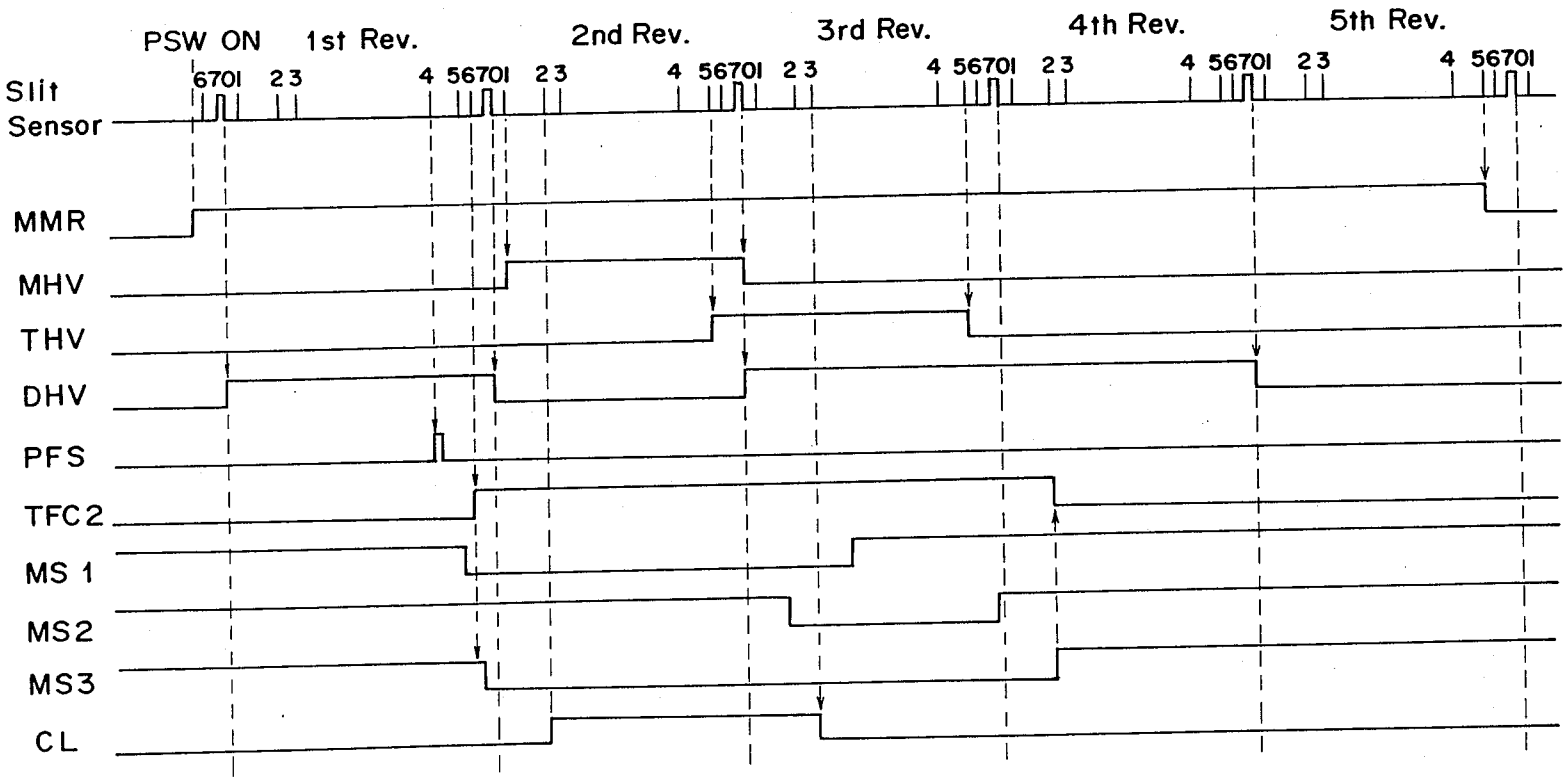
FIG. 6 shows a timing chart at the time that the three revolution process, namely, the enlargement mode is carried out.

As is apparent from the comparison of FIG. 6 with FIG. 5, the operation timing of the stop position sensor switch is delayed until the fourth revolution since the moving velocity of the platen is slowed down during the three revolution process.

Due to this, the timing for turning off the clutch TFC2 is also delayed into the fourth revolution. In other words, when a single copy is to be carried out in the enlargement mode, one copying cycle is finished after the fifth revolution. On the contrary to the above, when a single copy is to be carried out in the equal magnification mode, one copying cycle is finished after the fourth revolution.

Accordingly, it becomes possible to carry out a copying operation in the enlargement mode without any slow down of the copying speed in the equal magnification mode.

In the preferred embodiment just mentioned above, the cleaning step is done in the third and fourth revolutions of the master during the three revolution process, but the cleaning step in the fourth revolution can be omitted.

Second Embodiment

The present invention is also applicable to a variable magnification copy machine wherein either one of a reduction, equal magnification or enlargement modes is selectable. Accordingly, in this case, three clutch means are provided corresponding to these three modes (not shown in FIG. 3).

Figure 7A:
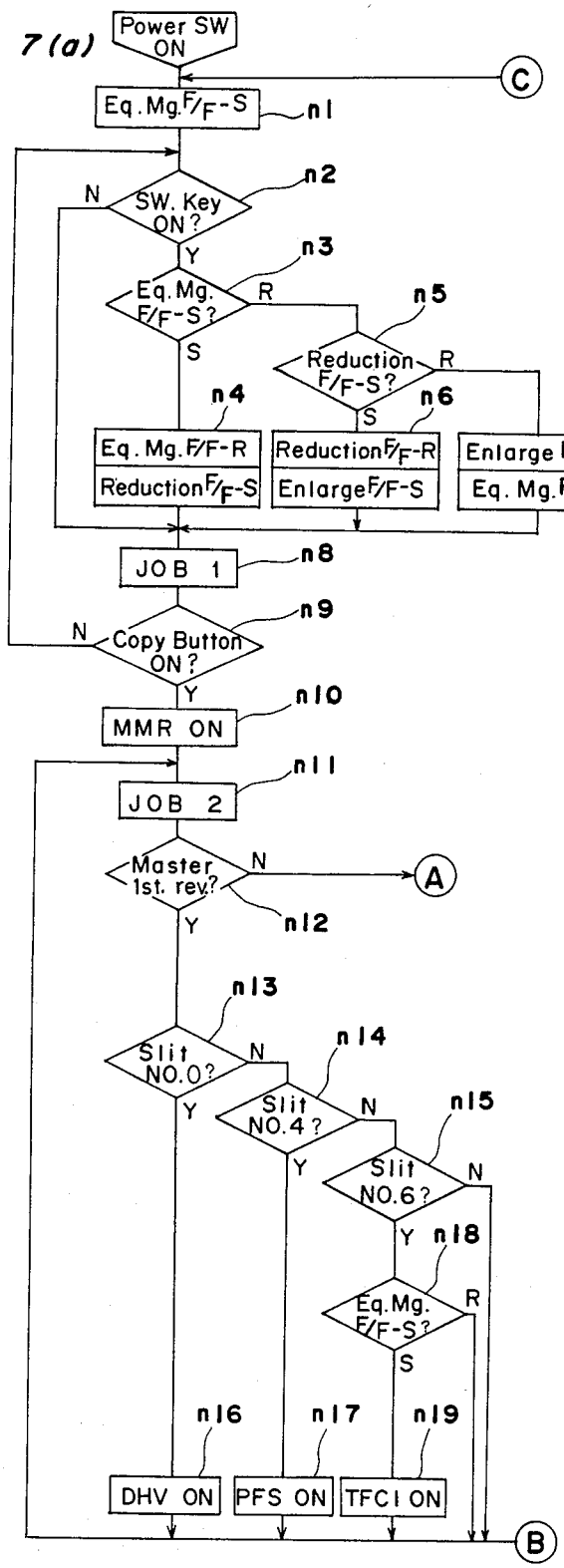
FIGS. 7(*a*) and (*b*) show a flow chart for executing a control program according to the second embodiment of the present invention.
Figure 7:
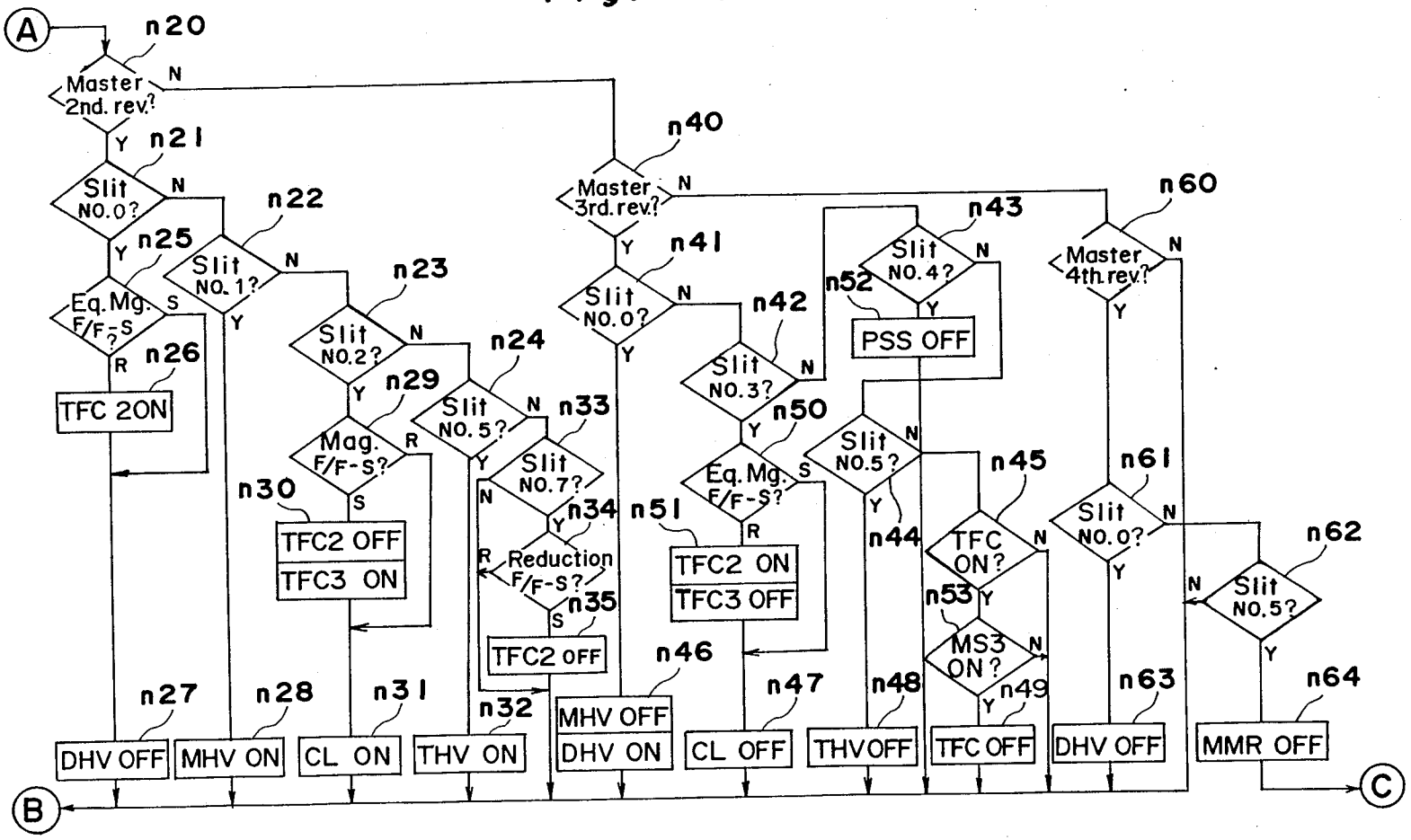

FIGS. 7(*a*) and (*b*) show a flow chart for executing the control program according to the second embodiment of the present invention.

When the power switch is turned on at step n1, a flip flop for the equal magnification mode is set. At this stage, the copy machine is set to the equal magnification mode. At step n2, it is decided whether the mode switching key SW was operated or not. If it was not operated, the process skips to step n8. If the switching key SW was operated, it is checked at step n3 whether the flip flop for an equal magnification mode was set or not. If it was set, the flip flop for the equal magnification mode is reset and the flip flop for the reduction mode is set at step n4.

If is was reset at step n3, the process proceeds from step n3 to step n5 to decide whether the flip flop for the reduction mode was set or not. If it was set, it is reset and the flip flop for the enlargement mode is set. Alternatively, if the flip flop for the reduction mode was reset, the process proceeds to step n7 and, thereat, the flip flop for the enlargement mode is reset and the flip flop for the equal magnification mode is set. According to these steps, the mode is cyclically switched among the three modes upon each operation of the switching key SW. Next, JOB1 for entering a number of copy or the like is carried out at step n8 and, when the copy button PSW is pushed at step n9, the process proceeds to step n10 to execute a series of copying operations.

At step n10, the main motor is started to drive by the main motor control signal MMR. Next, JOB2 for executing jobs necessary for carrying out one copying operation, for example, turning off a "ready" display is carried out. When the main motor is started to drive, the photo-sensitive belt 9, i.e. the master 9 is started to rotate.

If the master 9 is rotated in its first revolution, the process proceeds from step n12 to step n13 and, then, the slit number is detected according to the output signal of the slit sensor through steps n13 to n15.

If the slit number is "0" at first, the signal DHV is made "high" and the erasing charger 14 and the lamp 15 are energized at step n16. Namely, since the slit number is "0" at first, the master 9 is erased first.

When the slit number is detected to be "4", the signal PFS is made "high" and the paper supplying roller 18 is rotated by one revolution at step n17. Therefore, one blank copy paper is supplied from the paper supply cassette 17.

When the slit number is detected to be "6", it is decided at step n18 whether the flip flop for the equal magnification mode was set or not. If it was set, the process proceeds to step n19 and, thereat, the clutch for the equal magnification mode is turned on. If it was reset, in other words, the reduction mode or the enlargement mode was selected, the process returns directly to step n11.

During the second revolution of the master, steps n20 to n35 are carried out, and therefore, the actual copying processes are carried out.

When the slit number "0" is detected first, it is decided whether the flip flop for equal magnification was set or not. If it was reset, the clutch for the reduction mode is turned on by the signal TFC2 at step n26. Accordingly, if the reduction mode or the enlargement mode was selected, the clutch for the reduction mode is turned on when the slit number was detected to be zero in the second revolution of the master in the reduction mode or the enlargement mode.

When the copy button PSW was pushed down, the platen 2 is moved by a predetermined distance in the return direction thereof. And then, the platen 2 is moved in the foward direction thereof. Therefore, the platen 2 is moved backwards quickly even in the enlargement mode when the signal TFC2 was made "high". As will be mentioned later, the timing when the signal TFC3 is made "high" in the enlargement mode is a timing that the slit number is detected to be "2" during the second revolution. The reason why each ON-timing of individual clutches is differed according to the mode selected is that the switch sensor MS4 for sensing an exposure start position is operated at a same timing irrespective to the mode selected (usually, the signal TFC1 is made "high" at first, then the signal TFC2 is made "high" and the signal TFC3 is made "high" latest).

As shown in the timing chart of FIG. 2, the signal TFC1 is made "high" in the equal magnification mode at the timing that the slit signal is detected to be "6" in the first revolution of the master and the signal TFC2 is made "high" in the reduction mode when the slit number is detected to be "0" in the second revolution of the master. Also, in the enlargement mode, the signal TFC2 is made "high" at the timing that the slit number is equal to "0" in the second revolution and the signal TFC3 is made "high" in place of the signal TFC2 at the timing that the slit number becomes equal to "2" in the same revolution.

According to such timing control mentioned above, the sensor switch MS4 is made "high" at the same timing irrespective to the mode, namely, just after the slit number is detected to be "2" in the second revolution.

When the signal TFC2 is made "high" at step n26, the platen 2 is started to come back in the return direction at the velocity of the reduction mode, namely, the fastest velocity. Further, the erasing charger 14 and erasing lamp 15 are turned off at step n27. When the slit number was detected to be "1" during the second revolution at step n22, the electrifying charger 10 is turned on. When the slit number is detected to be "2" during the second revolution at step n23, it is checked at step n29 whether the flip flop for the enlargement mode was set or reset. If it was set, namely, the enlargement mode was selected, the process proceeds to step n30 and, thereat, the clutch is switched from TFC2 and TFC3. This timing is indicated by "A" in FIG. 8. Then, the light source 16 is turned on at step n31 to prepare the start of scanning. Just after this, the sensor switch MS4 is made "high" to indicate the exposure start position. When the slit number was detected to be "5" in the second revolution, the transferring charger 13 is turned on. When the slit number is detected to be "7", it is checked at step n34 whether the flip flop for the reduction mode was set or not. If the reduction mode was selected, the signal TFC2 is made "OFF". If the equal magnification mode or the enlargement mode was selected, the clutch (TFC1 or TFC3) is not turned off at this moment since the scanning speed is slowed down. These clutches will be turned off after entering into the third revolution of the master 9.

Figure 8:
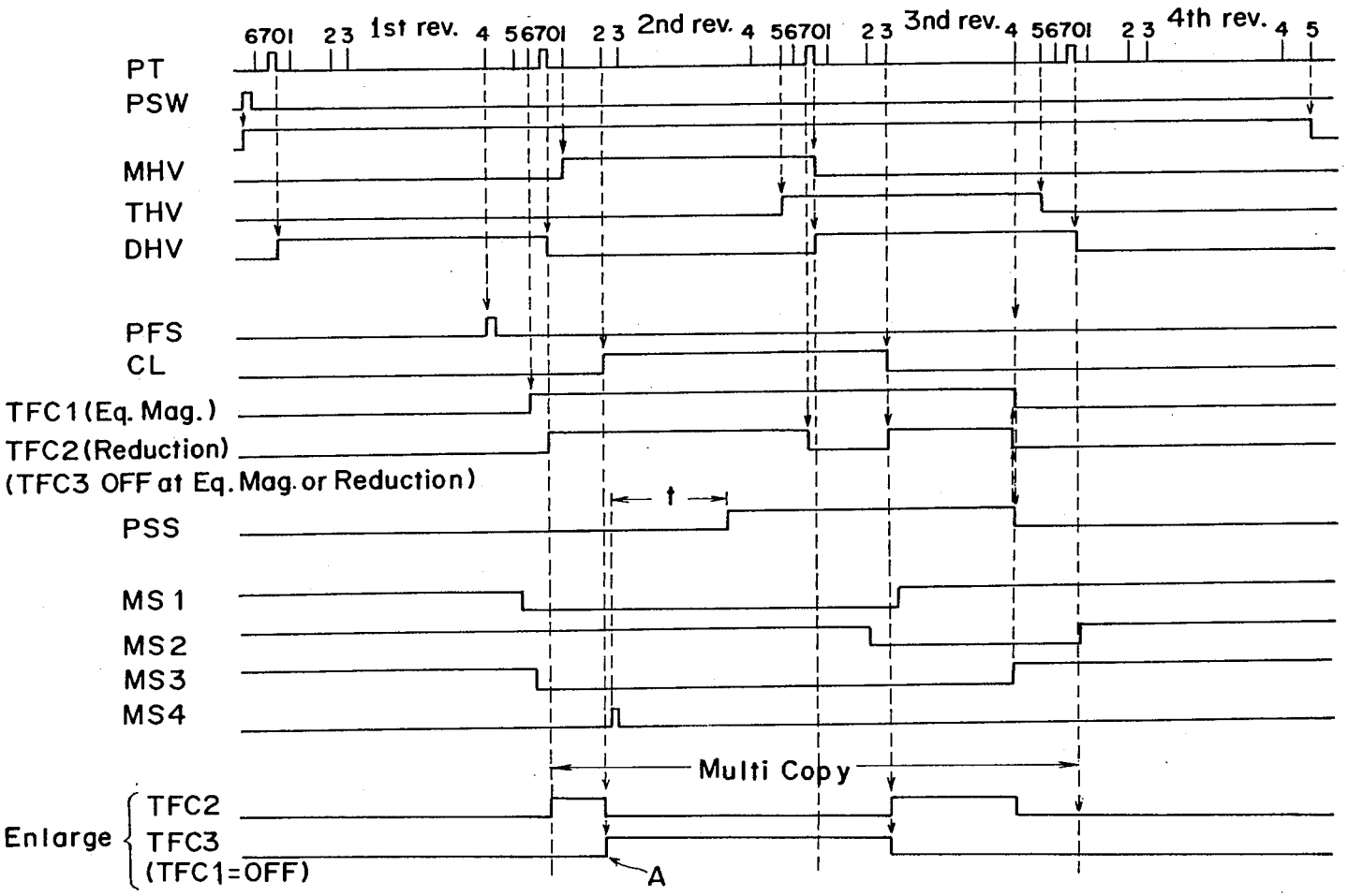
FIG. 8 shows a timing chart of the second embodiment of the present invention.

When the clutch TFC2 was turned off at step n35, the platen 2 is stopped at its present position. The timing of the slit number "7" is corresponded to that just before the third revolution of the master as shown in FIG. 8. Also, the timing of the slit number "7" is coincident with the timing that the platen is fed to the outermost position thereof. In other words, the angle plate member 6 reaches reached to the position of the drive gear 5 in FIG. 1. Accordingly, the platen 2 is stopped at the outermost position when the clutch TFC2 was turned off at step n35. Therefore, the time during which the platen is moved in the reduction mode is determined from the timing of the slit number "0" of the second revolution to that of the slit number "7" of the second revolution. In the equal magnification mode or the enlargement mode, the platen 2 is still moved foward even when the slit number is detected to be "7" during the second revolution of the master.

When a predetermined time interval "t" has passed from the timing of "switch on" of the sensor switch MS4, the paper supply switch PFS is turned on. When the switch PFS is turned on, the paper supply roller 20 is driven to feed the copy paper having been stopped thereat. The time interval "t" is adjusted to be best about individual copy machine and memorized in the ROM of the microcomputer. This time interval "t" is so chosen as to make the top end of the copy paper coincide with the top end of the image formed on the master.

After a while from the "switch on" of the switch PFS, the signal THV is made "high" and, therefore, the transferring charger 13 is energized. Accordingly, the toner image formed on the master is transferred onto the paper. The transfer of the image is carried out from the end of the second revolution to the third revolution.

When the master 9 is started to rotate in its third revolution, steps n40 to n52 are carried out. During the third revolution, the transferring image and the cleaning are carried out.

When the slit number is detected to be "0", the electrifying charger 10 is turned off and, in turn, the erasing charger 14 and lamp 15 are turned on at step n46. Due to this step, the cleaning is started. When the slit number is detected to be "3", it is decided at step n50 whether the flip flop for equal magnification mode was set or not. If the equal magnification mode was selected, the process proceeds to step n47 to turn off the light source 16.

If the reduction mode or the enlargement mode was selected, the process proceeds to step n51 and, thereat, clutch TFC2 is turned on and, clutch TFC3 is turned off.

Since the platen was already stopped at step n35 in the reduction mode, the platen is started to return at this moment. In the enlargement mode, the clutch is switched from TFC3 and TFC2 at this stage. In other words, if the enlargement mode was selected, the platen comes back at the return speed of the reduction mode. After the execution of step n51, the light source is turned off at step n47.

When the slit number was detected to be "4" during the fourth revolution, the switch PFS is turned off. Therefore, the paper supply roller 20 is stopped, but at that timing, the bottom end of the paper has been passed through the roller.

When the slit number is detected to be "5" during the third revolution, the transferring charger 13 is turned off. After it was turned off, the process proceeds to step n45 and to step n53 to wait until the platen 2 comes back to the stop position. When it is detected by the stop position sensor switch MS3 that the platen came back to the stop position, all of clutches (TFC1, TFC2 and TFC3) are turned off. Therefore, the platen 2 is stopped at this moment.

When the master 9 enters into its fourth revolution, the process proceeds to step n60 and to step n61, the erasing charger 14 and the erasing lamp 15 being turned off at the zeroth slit number. Due to this, all of chargers, clutches and lamps have been turned off. After the execution of step n63, the process is again proceeded from step n61 to n62. When the slit number is detected to be "5", the process proceeds to step n64 and the main motor is turned off and, then, is returned to step n1.

When the slit number is detected to be "3" during the third revolution of the master, the clutch is switched from TFC3 and TFC2 and, therefore, the platen comes back at the return speed of the reduction mode.

In the case of multi-copy, the process is controlled so as to enter into the second revolution of the next copying cycle just after the third revolution of the present copy cycle. And, the last copying cycle is finished after entering the third revolution to the fourth revolution.

While there has been described the preferred embodiments, modifications and variations being obvious to those skilled in the art are possible without departing from the spirit of the invention. The scope is therefore to be determined solely by the appended claims.

What is claimed is:

1. A variable magnification copy machine in which either a two revolution process wherein erasing and cleaning of a photo-sensitive means is carried out once in one copying cycle or a three revolution process wherein said erasing and cleaning of the photo-sensitive means is carried out twice in one copying cycle can be selected and in which a copying magnification is variable by varying a document scanning speed, said copy machine comprising:

means for selecting said two revolution process when an equal magnification mode is chosen; and means for switching from said two revolution process to said three revolution process when an enlargement mode is chosen.

2. A variable magnification copy machine according to claim 1, wherein said document scanning means includes a document platen and chain delivery means for driving said platen.

3. A variable magnification copy machine according to claim 2, wherein said chain delivery means includes at least two one-way clutches corresponding to a selected one of said equal magnification mode and said enlargement mode.

4. A variable magnification copy machine according to claim 3, wherein the one-way clutch for the enlargement mode is switched to the one-way clutch for the equal magnification mode just before the platen is started to return in the enlargement mode.

5. A variable magnification copy machine according to claim 1, wherein a reduction mode is also selectable together with the equal magnification mode and enlargement mode.

6. A variable magnification copy machine according to claim 1, further including switch means for switching from the one-way clutch for the enlargement mode to another one-way clutch for the reduction mode at the time that said document scanning means is started to return in the enlargement mode.

* * * * *